United States Patent [19]

Smith et al.

[11] Patent Number: 5,021,715

[45] Date of Patent: Jun. 4, 1991

[54] LIGHTING SYSTEM FOR ROADSIDE SIGNS

[76] Inventors: Norman D. Smith; Dresden G. Smith, both of 1621 English Dr., San Jose, Calif. 95129-4807

[21] Appl. No.: 332,617

[22] Filed: Apr. 3, 1989

Related U.S. Application Data

[63] Continuation-in-part of Ser. No. 149,690, Jan. 28, 1988, abandoned.

[51] Int. Cl.[5] ..... B60Q 1/02; H05B 41/36

[52] U.S. Cl. ..... 315/159; 315/82; 362/802

[58] Field of Search ..... 40/465, 560; 315/159, 315/82; 318/480; 340/933, 942; 362/183, 276, 802

[56] References Cited

U.S. PATENT DOCUMENTS 2,986,689 5/1961 Hofer ..... 318/480
3,720,913 3/1973 Bradford ..... 340/31 R
4,249,160 2/1981 Chilvers ..... 340/33
4,384,317 5/1983 Stackpole ..... 362/183

*Primary Examiner*—Eugene R. LaRoche
*Assistant Examiner*—Ali Neyzari
*Attorney, Agent, or Firm*—Robert Charles Hill

[57] ABSTRACT

A system including a telescopic switch and method of operation is disclosed for intermittently illuminating a roadside sign in response to a vehicle passing along a selected portion of the road, the system including a lighting element for illuminating the sign and a telescopic switch including a circuit for transmitting the control signal to the lighting element, a photocell for initiating the control signal and a telescopic lens for focusing the photocell on the selected road portion whereby the photocell is capable of sensing lights on a vehicle passing along the selected road portion in order to initiate the control signal and cause the lighting element to illuminate the sign.

13 Claims, 4 Drawing Sheets

LIGHTING SYSTEM FOR ROADSIDE SIGNS

This is a continuation-in-part of copending application Ser. No. 07/149690 filed on Jan. 28, 1988, abandoned.

FIELD OF THE INVENTION

The present invention relates to a lighting system or the like and a method for illuminating a roadside sign and more particularly to such a method and apparatus employed for roadside signs or the like at relatively remote locations.

BACKGROUND OF THE INVENTION

This is a continuation-in-part of U.S. patent application Ser. No. 07/149,690 filed Jan. 28, 1988 and now abandoned.

Generally speaking, roadside signs having lighting elements for illuminating them at night are more effective than signs which reflect light only, for example, from passing vehicles with passengers for whom the signs are intended. However, the requirement of providing lighting for such signs greatly limits the locations where the signs can be placed since a suitable power source must be provided for the lighting element.

In addition, it is of course desirable to minimize both installation costs and operating costs for the lighted signs.

The prior art has provided a variety of illumination systems for such signs or for similar locations requiring illumination. For example, U.S. Pat. No. 4,319,310 issued Mar. 9, 1982 to Kingsley disclosed a sign assembly with a self-contained solar array for operating an illuminating lamp or lamps for the sign. U.S. Pat. No. 4,283,657 issued Aug. 11, 1981 to Gordon, et al. disclosed an illuminating system for illuminating exit signs or the like. U.S. Pat. No. 4,200,904 issued Apr. 29, 1980 to Doan disclosed a solar powered street lighting system totally independent of any external power supply.

Other prior art references have provided various control systems for operating illuminating components such as those referred to above. For example, U.S. Pat. No. 3,720,913 issued Mar. 13, 1973 to Bradford disclosed a courtesy display operating under poor ambient light conditions for notifying a motorist leaving a private service area without turning on his headlights. The display system was initiated by a proximity sensor or trip plate operated by the car itself. Once operation was initiated, the display system included a photocell arranged in the path of the car leaving the service area to determine if its lights were on.

Similarly, U.S. Pat. No. 4,384,317 issued May 17, 1983 to Stackpole disclosed a solar powered lighting system including a light element, battery, photovoltaic panel, timer and various components to properly charge the battery and provide switching functions. This patent is generally representative of a number of other references disclosing solar powered lighting systems.

U.S. Pat. No. 4,249,160 issued Feb. 3, 1981 to Chilvers disclosed a light activated control system mounted on a vehicle for operating warning lights on the vehicle when it is parked at night, in response to light above a selected intensity level from an approaching vehicle. Here again, the warning system was dependent upon light from the approaching vehicle directly impinging upon a sensor for operating the warning system.

SUMMARY OF THE INVENTION

Accordingly, there has been found to remain a need for a system for intermittently illuminating roadside signs or the like in response to a light source at a remote location such as a selected portion of the road.

It is therefore an object of the invention to provide an improved illumination system for intermittently operated roadside signs and the like.

Preferably, the illumination system includes electric lights for illuminating the sign and a power source for energizing the lights, the power source preferably being a battery with a photovoltaic panel for recharging the battery during daylight hours. During nighttime hours or times of poor ambient lighting, when the system is preferably operable, a telescopic switch means is directed at a selected portion of the road to detect lights of an automobile or vehicle and thereupon actuate a control signal in a circuit for energizing the lights. The telescopic switch preferably includes a light sensor such as a photocell and an optically coupled telescopic lens capable of being focused on the selected road portion. With such an arrangement, the telescopic lens concentrates light from the vehicle onto the photocell in order to actuate or generate the control signal to energize the lights.

Such a system may be entirely remote from the road itself to better facilitate both installation and operation of the system. Even more preferably, the telescopic switch means preferably includes a telescopic lens having a preferably narrow field of view in order to ensure response of the system only to the vehicle lights on the selected road portion.

It is a further object of the invention to provide a similar method of operation for such a system. Even more preferably, the system and the method of operation contemplate means for aiming the telescopic lens in order to assure that its field of view coincides with the selected road portion.

In a preferred embodiment, the photocell means and the circuit means are preferably arranged in a housing having an opening for receiving the telescopic lens. An elongated tube extends from the telescopic lens and is even more preferably provided with a sighting means for assuring that the telescopic lens is directed toward the selected road portion.

The elongated tube is also preferably configured to prevent ambient light other than vehicular lights on the selected road portion from energizing the system. In addition, the housing acts in combination with the telescopic lens for enclosing and protecting the photocell. With such a combination, the elongated tube is also further configured for protecting the telescopic lens from environmental conditions including rain and wildlife. For example, as is described in greater detail below, the tube is configured for assuring drainage of water from the tube interior. At the same time, the tube is also configured for preventing insects or birds from entering the tube and interfering with proper operation of the telescopic lens.

Additional objects and advantages of the invention are made apparent in the following description having reference to the accompanying drawings.

DESCRIPTION OF THE PREFERRED EMBODIMENT

Figure 1:
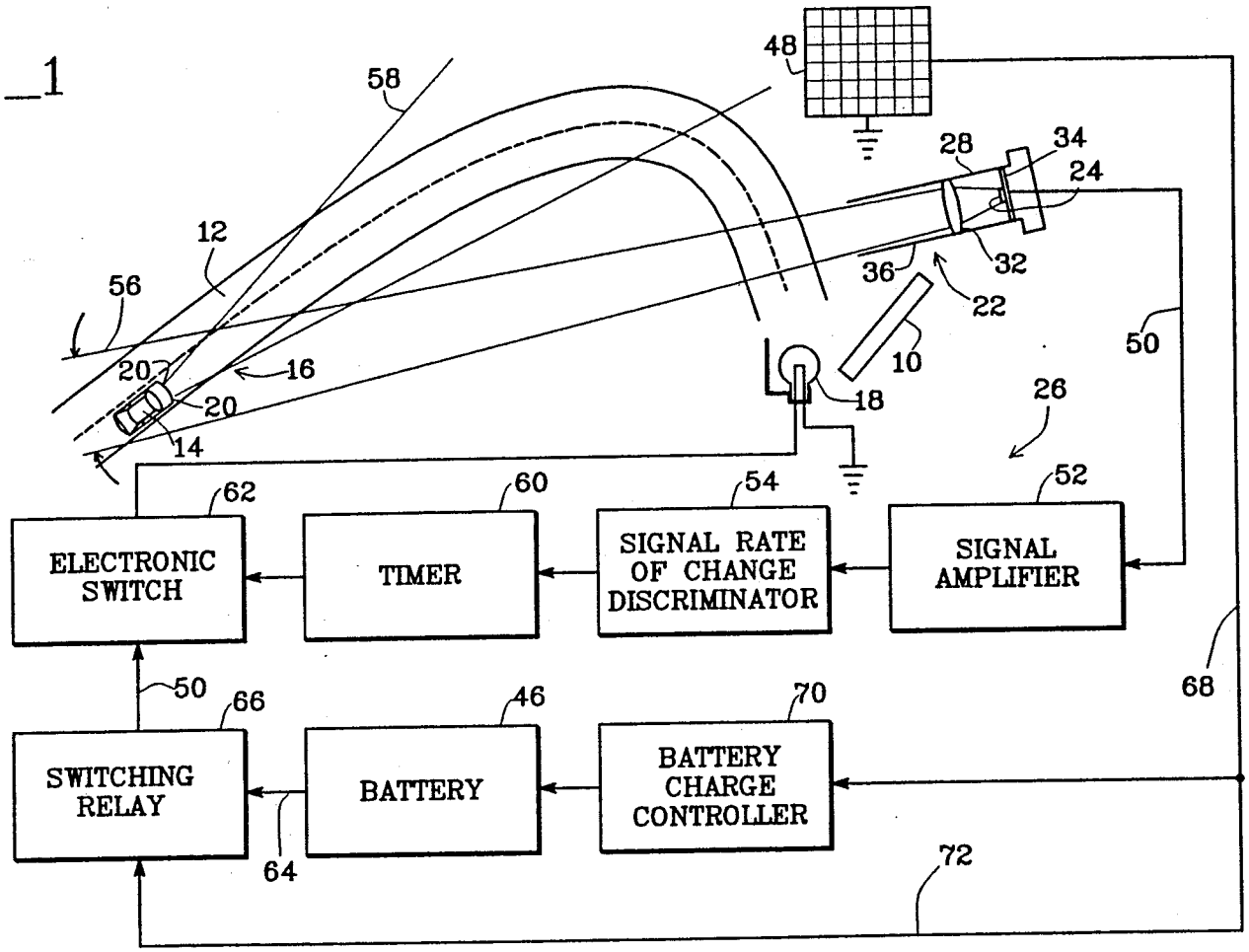
FIG. 1 is a schematic representation of a roadside sign and illuminating system constructed in accordance with the present invention.

Referring to the drawings and particularly to FIG. 1, a typical location for a sign 10 is illustrated alongside a road 12 for viewing by occupants of an automobile or vehicle 14 traveling along the road. In typical operation of the system, as the vehicle passes through a selected portion 16 of the road, for example where the vehicle rounds a curve, the sign 10 enters into full view of the passengers. At this time, it is desirable or preferable to illuminate the sign 10 intermittently or for a short time by one or more lamps or light elements 18 positioned adjacent the sign 10.

In accordance with the present invention, the light elements 18 are illuminated only when light from the headlamps 20 of the vehicle are detected by a telescopic switch means 22. The telescopic switch means 22 is described in greater detail below with reference to FIGS. 2–4. However, in a general sense, the telescopic switch means 22 includes a single photocell 24 and control circuit (or circuit board) 26 arranged in a protective housing 28. An opening 30 is provided in the housing 28 for a telescopic lens 32 which is adapted for focusing an external light source onto the photocell 24.

Preferably, a viewing glass (not shown), in the form of a plastic plate with one frosted surface, may be positioned at the focal point or focal plane of the lens with the photocell 24 being mounted in its center.

An elongated tube 36 is mounted on the housing 28 as described in greater detail below both to shield the telescopic lens 32 and the photocell 24 from ambient light sources and also to protect the telescopic lens 32 from various enviromental conditions.

The telescopic switch means 22, in accordance with the preceding description, is adapted for detecting light from a car at a substantial distance, for example up to one half mile or more from the location of the telescopic switch means 22. In order to assure that the telescopic switch 22 is properly focused upon the selected road portion 16 at this distance, sights 38 and 40, such as those employed upon rifles, are provided on the telescopic switch in order to permit initial sighting of the telescopic switch 22 to assure proper alignment of the telescopic lens 32 with the selected road portion 16. For example, the sights may be of a type where the front sight 38 is of a post type and the rear sight 40 is a peep sight type with an aperture opening.

As an optional feature, during installation of the system, the viewing glass 34 may also be employed for focusing the telescopic switch means 22 on the selected road portion 16. For example, cross-scribe marks (not shown) may be formed on the viewing glass 34 and employed during installation to assure that a light source on the selected road portion 16 is properly aligned for actuating the photocell 24.

A number of features or components may be provided, preferably in the control circuit 26, for further enhancing operation of the system. For example, the circuit 26 may include components to compensate for changes in background illumination and to provide for detection of motion of the vehicle headlamps. As is also noted below, a timer is also provided, preferably in the circuit 26, to continue actuation or energization of the light elements 18 for a predetermined period of time after an individual car is detected on the selected road portion 16. The circuit 26 may also preferably include means for resetting the predetermined time period if another car passes along the selected road portion 16 in order to assure that the sign 10 remains illuminated for a series of cars and also to prevent the light element 18 from cycling on and off on a frequent basis. The elimination of rapid cycling is of course desirable in order to preserve or maximize the life of the light elements, particularly flourescent lights which are commonly employed on many billboard signs.

In further accordance with the preferred description as described in greater detail below, the telescopic switch means 22 is best adapted for use with light elements such as those indicated at 18 which are energized by a battery 46 capable of being recharged, for example under control of the battery charge controller 70, referred to below, during daylight hours, by a photovoltaic panel 48. The telescopic switch means 22 and the illuminating system of the present invention may also of course be employed with line power; however, the savings or economic benefit is not as great in such a case.

It is also important to note that a single photocell 24 is preferably employed in the telescopic switch means 22 for nulling out background illumination in the target area formed by the selected road portion 16. At the same time, the single photocell 24 is also employed to detect the optical signal formed by the headlights 20 of the vehicle 14. Thus the telescopic switch means 22 is novelly adapted for nulling out background illumination in the target area or selected road portion 16 while at the same time detecting rapid illumination changes in the same target area represented by passage of a vehicle with its headlights 20 on and at a substantial distance as noted above.

Construction and operation of the telescopic switch means 22 is described in greater detail below.

When light from an approaching automobile or vehicle is detected, the photocell 24 generates a control signal which is transmitted through a conductor 50 to a signal amplifier 52 in the circuit 26. The amplified signal is transmitted to a signal rate-of-change discriminator 54 which is capable of detecting a rapid rate of change in the light signal. This allows the system or telescopic switch 22 to discriminate between ambient light sources such as the moon or other light sources of gradually changing intensity.

As noted above, light approaching the photocell 24 from the selected road portion 16 is concentrated by the telescopic lens 32 so that the telescopic switch means 22 is even more discriminating or sensitive. In the aspect of the invention, sensitivity results from the fact that the telescopic switch means 22 is responsive to the headlamps 20 of the vehicle being within the target area defined by the selected road portion 16 rather than in response to the beams from the vehicle headlamps. Thus, the telescopic switch means 22 responds to the vehicular headlamps 20 on the selected road portion 16 which is defined as that portion of the road generally falling within the angular field of vision 56 for the telescopic lens 32. This of course makes the telescopic switch means 22 much more sensitive to location of the vehicle 14 as compared, for example, to the response of a system to the headlight beams 58 which may themselves extend a substantial distance along the roadway.

Furthermore, the light elements 18 are preferably operated for a relatively short predetermined period of time in order to conserve energy and expense. For that purpose, a timer 60 initiates a timing sequence when the rate of change discriminator 54 responds to light from an approaching vehicle. The timer 60 transmits a signal to close an electronic switch 62. Closure of the switch 62 allows current to flow from the charged battery 46 through a conductor 64 and a closed switching relay 66 to the light elements 18 for energizing the lights and illuminating the sign to make it visible at night.

To allow the sign to be positioned at relatively remote locations where electric power lines or a power source is not available, the battery 46 is preferably charged during daylight hours by sunlight striking the photovoltaic panel 48. In conventional fashion, the photovoltaic panel 48 responds to the sunlight by generating electric current which passes through a conductor 68 to a battery charge controller 70. The battery charge controller assures that current is passed to the battery 46 only when the battery is charged at less than full value. Otherwise, the circuit is opened to prevent overcharging of the battery.

Another conductor 72 is connected with the switching relay 66 to signal whether it is daylight or nighttime for determining when the sign or signs 10 should be illuminated by the light elements 18. Obviously, since lighting of the sign is undesirable during daylight hours, or at least during periods of relatively strong ambient lighting, the switching relay 66 selectively disconnects the battery 46 from the conductor 50 when the photovoltaic panel 48 is producing voltage.

Thus, the light sensitive telescopic switch means 22 is employed to illuminate the sign 10 only when an automobile or vehicle is approaching. Thus, the system may be relatively small and/or compact, for example, because the battery 46 need only provide current energy for the light elements 18 during a small portion of the nighttime.

Additionally, operation of the telescopic switch means 22 in accordance with the preceding description and as further described below provides additional impact in attracting attention of passing motorists and passengers by the fact that the lights 18 are actuated to illuminate the sign 10 while the vehicle is approaching the sign.

Figure 2:
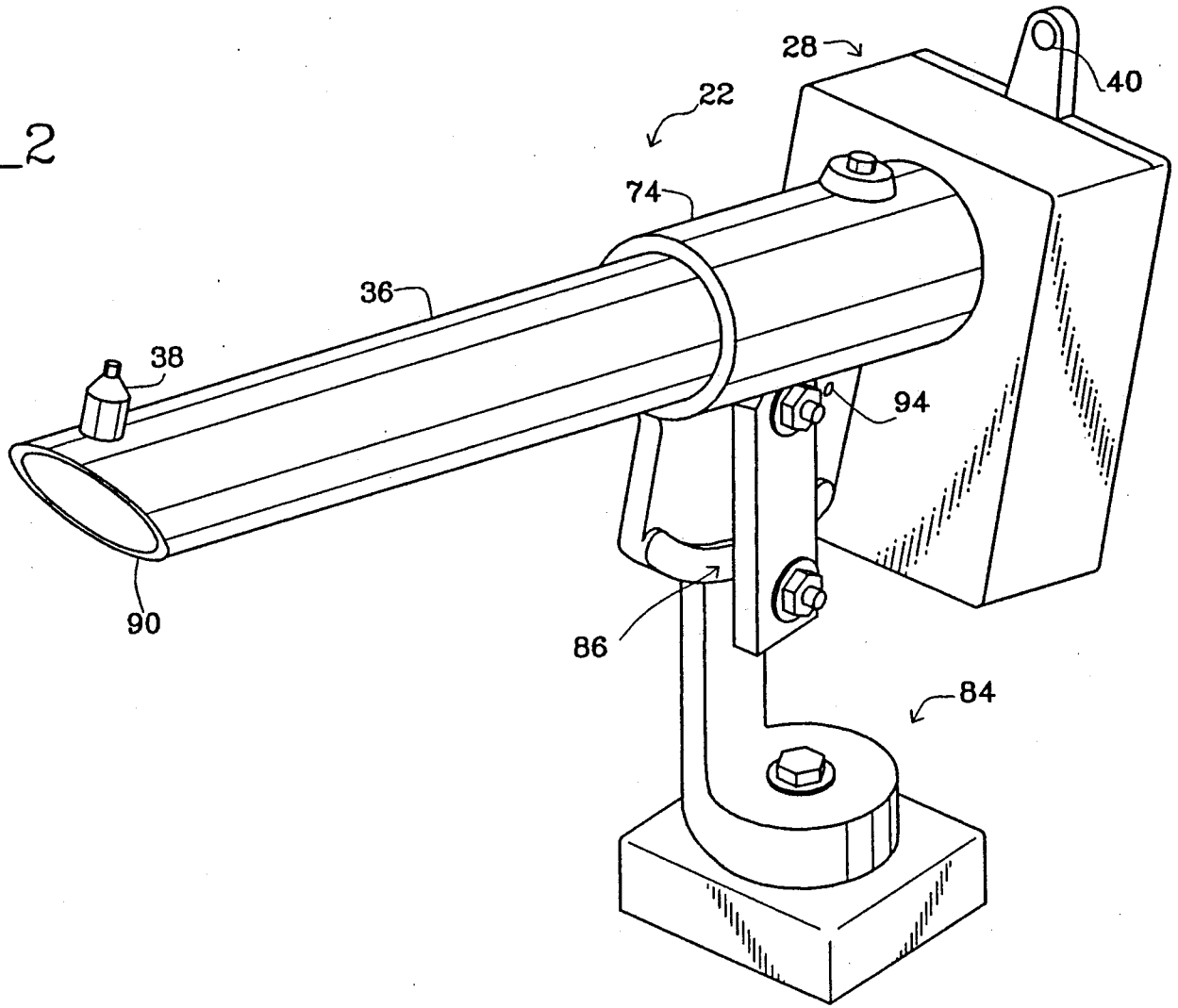
FIG. 2 is a perspective representation of a telescopic switch adapted for use in the illuminating system and method of operation for the present invention.
Figures 3, 3A:
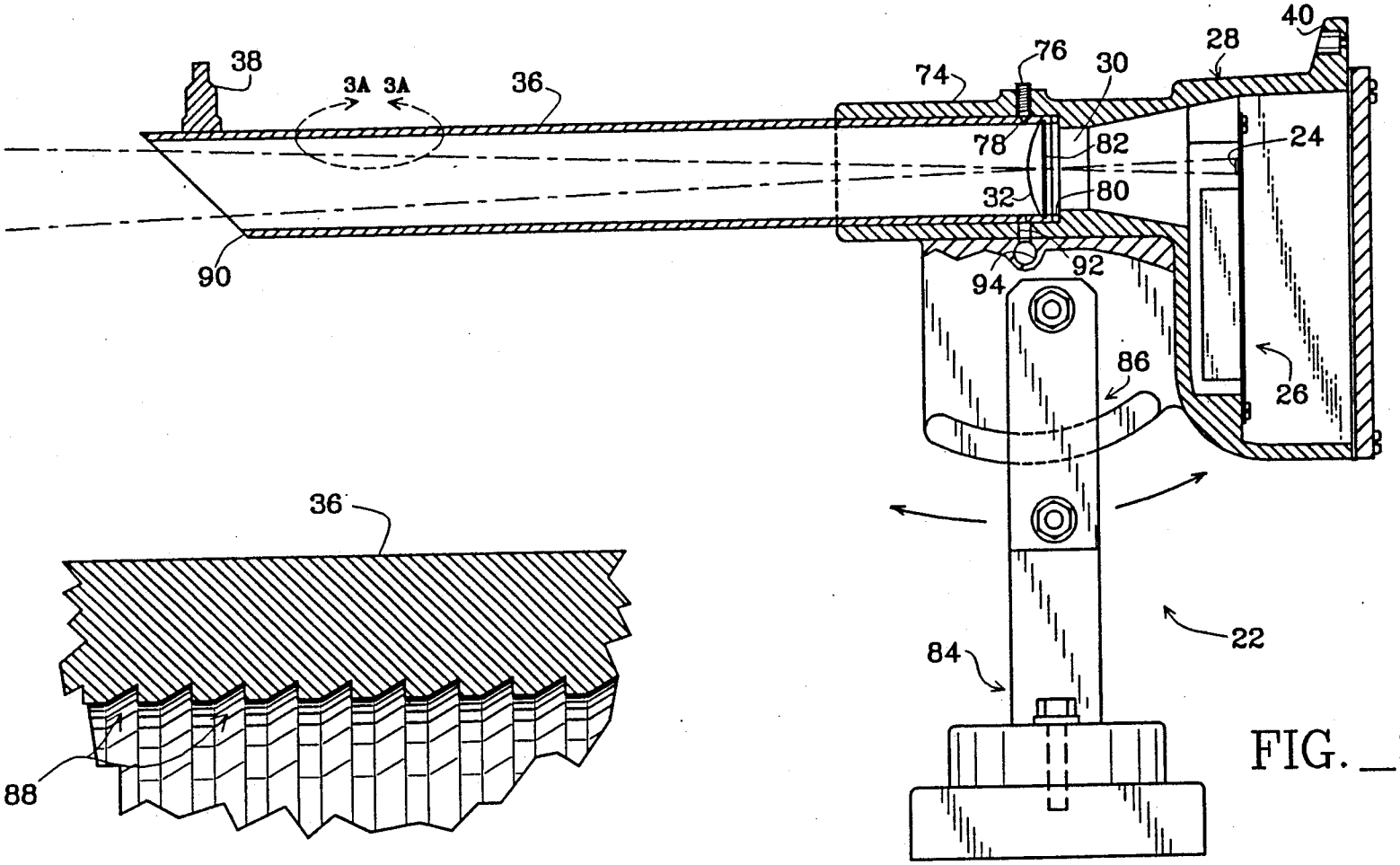
FIG. 3 is a longitudinally sectioned view of the telescopic switch of FIG. 2 in order to better illustrate its internal construction.
FIG. 3A is an enlarged view of an elongated tube also illustrated in FIG. 3.
Figure 4:
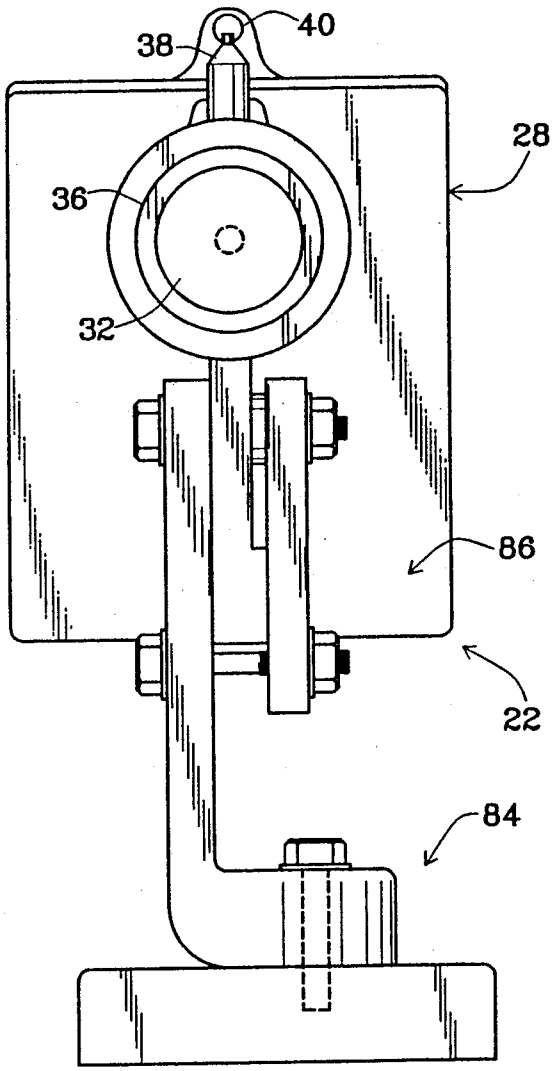
FIG. 4 is a front view of the telescopic switch assembly to even further illustrate its construction.

Referring now to FIGS. 2–4 in combination the photocell 24 and control circuit 26 are preferably mounted within the housing 28 as illustrated. The telescopic lens is preferably positioned within the housing opening 30 and in proper optical association with the photocell 24 by placement of the elongated tube 36 in a surrounding housing portion 74. A set screw 76 is mounted in the housing portion 74 for engagement with a tapered opening 78 in the elongated tube 36. Relative positioning of the set screw 76 and tapered opening 78 causes the elongated tube 36 to be drawn inwardly or rightwardly as viewed for example in FIG. 3 by tightening of the set screw 76. This is turn urges the tube 36 against an O-ring 80 to assure proper optical register or focus between the lens 32 and photocell 24. A retaining ring 82 is mounted on the tube 36 along with the lens 32.

The housing 28 of the telescopic switch means 22 may be pivoted and secured relative to a base portion 84 by a clamping assembly generally indicated at 86. Thus, the clamping assembly 86 may be employed in combination with the sights 38 and 40 for properly focusing the telescopic switch means 22 on the selected road portion 16.

As noted above, the telescopic lens 32 has a relatively narrow field of vision as indicated at 56, for example of about 5°–15° in order to limit response to vehicles only on that portion of the road.

The length of the elongated tube 36 tends to prevent extraneous light from impinging upon the lens 32 or passing to the photocell 24. In order to further prevent passage of extraneous light through the lens 32, concentric angular grooves 88 are preferably formed along the interior of the tube 36 for trapping such extraneous light. Preferably, as illustrated in FIG. 3A, the grooves are spaced apart about 0.030 inches. Furthermore, the grooves preferably have a leading edge forming an angle of about 30° with respect to the interior surface of the tube and a trailing surface approximately perpendicular to the surface of the tube. The grooves are from about 0.005 to about 0.010 inches deep and are otherwise configured as illustrated in FIG. 3A for purposes of the present invention.

A forward end 90 of the tube 36 is angled downwardly and rearwardly, at an angle of preferably about 45°, to prevent birds and the like from landing upon or entering the tube. In addition, the interior and exterior surfaces of the tube 36 are preferably blackened so that, at least during daylight hours, the interior of the tube is substantially hot. This further prevents insects such as spiders from entering the tube and building webs or the like (not shown) which might interfere with optical performance of the lens 32.

A drain opening 92 is formed in the tube 36 and housing portion 74 just forward of the lens 32 to prevent water from accumulating in the tube and interfering with operation of the lens 32 and photocell 24. The drain opening 92 connects with a cross-drilled passage 94 to allow water in the tube to escape therefrom.

Operation of the system and telescopic switch means 22 is believed apparent from the preceding description. However, operation is very briefly described below in order to further assure a complete understanding of the invention.

Initially, light elements such as those indicated at 18 are provided for a roadside sign as indicated at 10. The telescopic switch means 22 is formed to provide the photocell 24, the telescopic lens 32 and the circuit means 26 for performing as generally described above.

With that combination of elements, the telescopic lens 32 is then aimed at the selected road portion 16 in order to assure response of the telescopic switch means 22 only to vehicles passing along the selected road portion. With the components otherwise operating as described above, the telescopic switch means 22 and the other components of the lighting system as described above then function in response to headlamps from passing vehicles, at least during nighttime hours to intermittently illuminate the roadside sign 10.

There has thus been described above a preferred embodiment and method of operation for a system for intermittently illuminating roadside signs and the like. Various modifications and addition, besides those specifically set forth above, will be apparent, particularly to those skilled in the art. Accordingly, the scope of the invention is defined only by the following appended claims.

What is claimed is:

1. A system for illuminating a roadside sign in response to a vehicle passing along the road, comprising a lighting means for illuminating the sign and a telescopic switch means including;

circuit means adapted for transmitting a control signal to actuate the lighting means, photocell means coupled with the circuit means for initiating the control signal, and telescopic means providing focused optical communication between the photocell means and a selected portion of the road at a substantially distant location of at least ¼ of a mile whereby light from a vehicle passing along the selected road portion is sensed by the photocell means in order to initiate the control signal for actuating the lighting means, the telescopic means further comprises a lens means optically associated with the photocell means, the lens means having a defined field of view, and means for focusing the field of view of the lens means on the selected road portion whereby the system is entirely remote from the road, the telescopic means further comprises means for aiming the lens means to have its field of view coincide with the selected road portion, the telescopic means further comprises means for shielding the photocell means from extraneous light sources outside of the field of view for the lens means, the shielding means comprises an elongated tube extending from the lens means and encompassing its field of view, the telescopic switch means further comprises a housing which acts in combination with the lens means to enclose the photocell means.

2. The system of claim 1 wherein the aiming means comprises sighting means at least partially mounted on the elongated tube.

3. The system of claim 1 wherein the housing includes means for replaceably retaining the tube and lens means in register with each other and with the photocell means.

4. The system of claim 1 wherein the circuit means is arranged within the housing.

5. The system of claim 1 wherein the elongated tube is configured to protect the lens means from the environment.

6. The system of claim 1 wherein the telescopic means further comprises means for shielding the photocell means from extraneous light sources outside of the field of view for the lens means.

7. The system of claim 1 wherein the shielding means comprises an elongated tube extending from the lens means and encompassing its field of view.

8. The system of claim 1 wherein the telescopic switch means further comprises a housing which acts in combination with the lens means to enclose the photocell means.

9. The system of claim 1 wherein the lens means has a narrow field of view in order to substantially limit response of the system to vehicles traveling along the selected road portion.

10. The system of claim 1 wherein the circuit means comprises a rate-of-change discriminator for generating the control signal in response to a change in the intensity of light detected.

11. The system of claim 1 further comprising means for preventing the lighting means from being actuated during the daytime.

12. The system of claim 1 further comprising battery means for energizing the lighting means under control of the circuit means and solar powered photovoltaic means for recharging the battery means.

13. A telescopic switch capable of initiating a control signal for an intermittently operated system in response to a light source of an approaching vehicle from at a substantially remote location of at least ¼ of a mile, comprising;

circuit means adapted for transmitting the control signal to the intermittently operated system, photocell means coupled with the circuit means for initiating the control signal, a telescopic lens means optically associated with the photocell means, the telescopic lens means having a defined field of view, means for focusing the telescopic lens means to have its field of view coincide with the substantially remote location whereby the telescopic switch is capable of sensing a light source at the substantially remote location in order to initiate the control signal for the intermittently operated system, means for shielding the photocell means from extraneous light sources outside of the field of the view for the telescopic lens means, an elongated tube extending from the telescopic lens means and encompassing its field of view, the elongated tube being configured to protect the lens means from the environment, and a housing acting in combination with the telescopic lens means to enclose the photocell means.

* * * * *